US005881914A

United States Patent [19]

Tsuda et al.

[11] Patent Number: 5,881,914

[45] Date of Patent: Mar. 16, 1999

[54] ADHESIVE DISPENSER

[75] Inventors: Mamoru Tsuda, Okazaki; Akihiro Udagawa, Toyota, both of Japan

[73] Assignee: Fuji Machine Mfg. Co., Ltd., Chiryu, Japan

[21] Appl. No.: 938,971

[22] Filed: Sep. 26, 1997

[30] Foreign Application Priority Data

Oct. 1, 1996 [JP] Japan ..... 8-260595

[51] Int. Cl.[6] ..... B67D 5/05; B67D 5/62; B67D 5/42; B65D 88/54

[52] U.S. Cl. ..... 222/54; 222/52; 222/58; 222/146.5; 222/389; 222/325

[58] Field of Search ..... 222/54, 146.5, 222/389, 325, 55, 52

[56] References Cited

U.S. PATENT DOCUMENTS

| | | | |
|---|---|---|---|
| 4,150,770 | 4/1979 | Wieland, Jr. et al. | 222/394 |
| 4,600,124 | 7/1986 | Price | 222/54 |
| 5,029,731 | 7/1991 | Klatt | 222/54 |
| 5,332,125 | 7/1994 | Schmitkons et al. | 222/54 |
| 5,335,825 | 8/1994 | Fort | 222/330 |
| 5,462,199 | 10/1995 | Lenhardt | 222/54 |

FOREIGN PATENT DOCUMENTS

A 4-250869 9/1992 Japan .

*Primary Examiner*—Andres Kashnikow
*Assistant Examiner*—Keats Quinalty
*Attorney, Agent, or Firm*—Oliff & Berridge, PLC

[57] ABSTRACT

An adhesive dispenser for iteratively dispensing a controlled amount of an adhesive from a reservoir, by iteratively applying a pressure to the adhesive stored in the reservoir such that the controlled amount of adhesive is released from a nozzle connected to the reservoir via a supply passage and is applied to an object, the adhesive dispenser including at least one of an adhesive-temperature control device which controls a temperature of the adhesive present in the supply passage, by supplying a fluid to a first space at least partly surrounding at least a portion of the supply passage, and a pressure control device which is switchable to at least a pressing state thereof in which the pressure control device supplies a pressurized gas to a second space above the adhesive stored in the reservoir and a sucking state thereof in which the pressure control device sucks the gas from the second space.

21 Claims, 4 Drawing Sheets

ADHESIVE DISPENSER

BACKGROUND OF THE INVENTION

1. Field of the Invention

The present invention relates to an adhesive dispenser and particularly to the art of controlling the amount of adhesive dispensed from the dispenser.

2. Related Art Statement

There is known an adhesive dispenser which iteratively dispenses a controlled amount of an adhesive from a reservoir therefor, by iteratively applying a pressure to the adhesive stored in the reservoir such that the controlled amount of adhesive is released from a nozzle connected to the reservoir via a supply passage and is applied to an object. In the known adhesive dispenser, the pressure applied to the adhesive is increased by supplying a pressurized gas to a space above the adhesive stored in the reservoir, and is decreased by communicating the space with the atmosphere. In the pressing state in which the pressure applied to the adhesive is increased, the adhesive is released from the nozzle and, in the gas-releasing state in which the air is released from the space above the adhesive to the atmosphere, the releasing of the adhesive is stopped. Accordingly, if the pressing state and the gas-releasing state are iteratively switched to each other in an appropriate manner, the adhesive can be applied in suitably controlled amounts to objects.

Since the viscosity of adhesive influences the amount of application of adhesive, the temperature of adhesive is maintained at an appropriate value, when the adhesive is applied. To this end, the whole dispenser is covered by a cover member, and the temperature of an entire inner space of the cover member is controlled by a cooler including a compressor, or a coil heater. That is, the temperature of adhesive is controlled by changing the temperature of the entire inner space of the cover member.

After the adhesive is applied to the object, the known dispenser is switched from the pressing state to the gas-releasing state. In the gas-releasing state, however, the pressure in the space above the adhesive cannot be quickly decreased down to values at which the releasing of adhesive stops. Thus, the releasing of adhesive cannot be quickly stopped. That is, the known dispenser cannot accurately control the amount of application of adhesive.

In addition, the known dispenser needs a long time for controlling the temperature of adhesive to a desired value, because the temperature of the inner space of the cover member must be controlled and additionally there is a time lag after the inner space is controlled to the desired value and before the temperature of adhesive in the reservoir is changed to the desired value. Moreover, much energy is needed for controlling the adhesive to the desired temperature. The cover member employed for covering the whole dispenser results in increasing the overall size of the dispenser.

SUMMARY OF THE INVENTION

It is therefore an object of the present invention to provide an adhesive dispenser which easily controls the amount of application of adhesive, by shortening a time duration needed for changing the temperature of adhesive to a desired value, and/or quickly stopping the releasing of adhesive after the application of adhesive.

The present invention provides an adhesive dispenser which has one or more of the technical features which are described below in respective paragraphs given parenthesized sequential numbers (1) to (21). Any technical feature which includes another technical feature shall do so by referring, at the beginning, to the parenthesized sequential number given to that technical feature. Thus, two or more of the following technical features may be combined, if appropriate. Each technical feature may be accompanied by a supplemental explanation, as needed, in the corresponding paragraph.

(1) According to a first feature of the invention, there is provided an adhesive dispenser for iteratively dispensing a controlled amount of an adhesive from a reservoir therefor, by iteratively applying a pressure to the adhesive stored in the reservoir such that the controlled amount of adhesive is released from a nozzle connected to the reservoir via a supply passage and is applied to an object, the adhesive dispenser comprising at least one of (A) an adhesive-temperature control device which controls a temperature of the adhesive present in the supply passage, by supplying a fluid to a first space at least partly surrounding at least a portion of the supply passage, and (B) a pressure control device which is switchable to at least a pressing state thereof in which the pressure control device supplies a pressurized gas to a second space above the adhesive stored in the reservoir and a sucking state thereof in which the pressure control device sucks the gas from the second space. The present adhesive dispenser may be equipped with both, or either one, of the adhesive-temperature ("AT") control device and the pressure control device. The AT control device which controls the temperature of the adhesive may be one which accurately controls the temperature of the adhesive to a desired value, or may be one which controls the temperature of the adhesive so that the dispenser accurately dispenses the adhesive in desired amounts. In the latter case, it does not matter whether the temperature of the adhesive is accurately controlled to a desired value. However, if the pressure in the space above the adhesive and the pressing time in which the pressure is applied to the adhesive are accurately controlled at respective appropriate values, it can be said that the amount of adhesive applied to an object depends on only the viscosity of the adhesive. Therefore, in the case where the viscosity of the adhesive unconditionally depends on the temperature of the same, the control of the amount of application of adhesive to a desired value means the control of the temperature of adhesive to a desired value. The fluid supplied by the AT control device to the first space may be a gas or a liquid. If air is used as the fluid, the air which has been used may be released into the atmosphere; on the other hand, if a liquid that has a high thermal conductivity is used, it can quickly change the temperature of the adhesive in the supply passage to an appropriate value (i.e., predetermined value, or value at which the adhesive is applied in desired amounts). The gas supplied by the pressure control device to the second space may be air, nitrogen gas, inert gas, etc. The nitrogen gas or inert gas can effectively prevent the oxidization of the adhesive. The pressure control device may be one which is additionally switchable to a pressure-maintaining state in which the control device maintains the pressure of the second space at a desired pressure value, and/or to a gas-releasing state in which the control device communicates the second space with the atmosphere. Although the desired pressure may be a predetermined value, it is preferred that the desired pressure be a variable which varies depending on the remaining amount of adhesive in the reservoir. In the latter case, irrespective of whether the remaining amount of adhesive in the reservoir is large or small, the pressure applied to the adhesive present in the outlet of the nozzle is maintained at a constant value, and accordingly the level of the lower end of the adhesive present in the outlet of the nozzle is accurately maintained at a constant value, while the adhesive is not applied to objects. Thus, the accuracy of control of the amount of application of adhesive is much improved. The remaining amount of adhesive can be measured by detecting the level of the upper surface of the adhesive stored in the reservoir, or measuring the weight of the remaining adhesive. The AT control device controls the temperature of adhesive to an appropriate value, by supplying the fluid to the first space around the supply passage. If the temperature of the fluid supplied to the first space is higher than that of the adhesive, the latter temperature is raised and, if the former is lower than the latter, the latter is lowered. Accordingly, the temperature of adhesive can easily be changed to an appropriate value, by changing the temperature of fluid supplied to the first space to an appropriate value. However, this is not an essential manner. The temperature of adhesive can be controlled at an appropriate value, by, for example, controlling the supplying of a fluid whose temperature is higher, or lower, than an appropriate value to the first space while the temperature of adhesive in the supply passage is measured. In the case where the temperature of adhesive is largely different from an appropriate value, in particular, largely lower than the same, the AT control device may first supply, to the first space, air whose temperature is much higher than the appropriate value and, as the temperature of adhesive in the supply passage approaches the appropriate value, supply air whose temperature correspondingly approaches the same value. In this case, too, the temperature of adhesive in the supply passage can be changed to the appropriate value in a short time. The AT control device may supply the fluid to the first space, by supplying the fluid to a fluid passage provided around the supply passage, or directly blowing the fluid through the first space against the supply passage. In either case, the AT control device does not control the temperature of an entire inner space of a cover member which covers a whole adhesive dispenser, in contrast to the known manner. Therefore, the present adhesive dispenser can shorten the time period needed to change the temperature of adhesive to an appropriate value. In addition, the present dispenser can reduce the amount of energy needed to reach the same goal, while preventing the enlargement of overall size thereof. When the pressure control device is switched to the pressing state and the sucking state, the pressure applied to the adhesive stored in the reservoir is increased and decreased, respectively. In the pressing state, the pressure control device supplies the pressurized gas to the second space above the adhesive to increase the pressure in the second space, so that the adhesive is pressed and spouted from the nozzle. When the pressure control device is switched from the pressing state to the sucking state, it sucks the gas from the second space to decrease the pressure of the second space, so that the adhesive is sucked and the releasing thereof from the nozzle is stopped. Thus, the pressure control device is switched from the pressing state to the sucking state when the releasing of the adhesive is terminated, in contrast to the known adhesive dispenser in which in the same situation a pressure control device is switched from a pressing state to a gas-releasing state in which a space above adhesive is communicated with the atmosphere. Therefore, the present dispenser can more quickly decrease the pressure of the second space than the known dispenser and accordingly more quickly stop the releasing of adhesive from the nozzle. In addition, during time durations in which the present dispenser does not dispense the adhesive, it can accurately maintain the level of the exposed lower end or face of the adhesive present in the outlet of the nozzle. Thus, the present dispenser enjoys improved accuracy of control of the adhesive releasing amount.

(2) According to a second feature of the present invention which includes the first feature (1), the adhesive dispenser comprises the adhesive-temperature control device, and the adhesive-temperature control device comprises, as the first space, an air passage which at least partly surrounds at least the portion of the supply passage; an air heater which heats an air as the fluid; an air cooler which cools an air; an air supply device which is switchable to a heated-air supply state thereof in which the air supply device supplies, to the air passage, the air which has been heated by the air heater and has not been cooled by the air cooler and to a cooled-air supply state thereof in which the air supply device supplies, to the air passage, the air which has been cooled by the air cooler and has been heated by the air heater; and an air-heater control device which controls the air heater and thereby controls a temperature of the air supplied to the air passage. The air passage may not be one which completely surrounds the entirety of the supply passage, but may be one which at least partly surrounds at least a portion of the supply passage. In the case where the air passage is one which fully surrounds an intermediate portion of the supply passage, it may take any shape, for example, an annular or a helical shape. When the air supply device is in the cooled-air supply state, the air supply device may supply, to the air passage, the air which has been cooled by the air cooler and then heated by the air heater, or the air which has been heated by the air heater and then cooled by the air cooler. If the air supply device is switched to the heated-air supply state, the air which has been heated by the air heater but has not been cooled by the air cooler and which has a temperature not lower than that of the atmosphere, is supplied to the air passage. On the other hand, if there is a need to supply the air passage with the air having a temperature not higher than that of the atmosphere, the air supply device is switched to the cooled-air supply state in which the air which has been cooled by the air cooler and heated by the air heater is supplied to the air passage. In either case, the temperature of the air supplied to the air passage is controlled by the air-heater control device which controls the air heater, so that the temperature of the adhesive present in the supply passage is controlled to about an appropriate value. Generally, it is easier to control an air heater than to control an air cooler. Therefore, whether the temperature of the air supplied to the air passage may be not higher, or not lower, than that of the atmosphere, it is preferred that the air heater be controlled to control the temperature of the air. However, the present invention encompasses the case where the air cooler is controlled to control the temperature of the air supplied to the air passage. In a representative embodiment according to the second feature (2), the temperature of the air supplied to the air passage is controlled to be equal to a desired temperature of the adhesive present in the supply passage. In this embodiment, when the air supply device is in the heated-air supply state, the air whose temperature has been heated by the air heater to the desired value is supplied to the air passage. On the other hand, when the air supply device is in the cooled-air supply state, the air which has been cooled by the air cooler is supplied to the air heater which in turn heats the air to a desired value lower than the temperature of the atmosphere, so that the heated air is supplied to the air passage. Alternatively, the air may be heated by the air heater to a temperature higher by a predetermined value, ΔT, than a desired value and then cooled by the air cooler by the predetermined value ΔT to the desired value, so that the cooled air is supplied to the air passage. For example, a vortex tube may be employed as an air cooler which can lower the temperature of air by a predetermined value. According to the second feature (2), the temperature of the adhesive present in the supply passage can be controlled to a desired value, irrespective of whether the temperature of the atmosphere is higher or lower than the desired value. Accordingly, the amount of adhesive applied to each object can be controlled with accuracy. In other words, the temperature of the adhesive can be controlled to any value falling in the range whose upper limit is equal to the highest possible temperature to which the air heater can heat air, and whose lower limit is equal to the lowest possible temperature to which the air cooler can cool air. If the temperature of the adhesive can be controlled in a wide range, a great number of sorts of adhesives can be used at their appropriate temperatures.

(3) According to a third feature of the present invention which includes the first feature (1) or the second feature (2), the adhesive dispenser comprises the pressure control device, and the pressure control device is switchable to a gas-releasing state in which the pressure control device communicates the second space with an atmosphere. In the gas-releasing state, the pressure control device may communicate the second space with the atmosphere directly, or indirectly, e.g., via a check valve.

(4) According to a fourth feature of the present invention which includes the third feature (3), the pressure control device comprises a pressure-decreasing device which decreases a pressure in the second space such that during at least a portion of a time duration in which the pressure control device is switched from the pressing state to a non-pressing state comprising at least one of the sucking state and the gas-releasing state, the pressure of the second space is decreased at a rate greater than a rate at which the pressure of the second space would be decreased if the second space were communicated with an atmosphere only. According to the fourth feature (4), the pressure control device is not essentially required to decrease the pressure of the second space at the greater rate throughout the time duration in which the pressure control device is switched from the pressing state to the non-pressing state, but is required to decrease the pressure of the second space at the greater rate during at least a portion of the time duration. For example, the pressure of the second space may be decreased at the greater rate, by sucking, from the second space during at least a portion of the time duration, the amount of air which is larger than the amount of air which would be released from the second space to the atmosphere if the second space were communicated with the atmosphere only. When the pressure control device is switched to the sucking state, it may also be switched to the gas-releasing state. In the latter case, too, the pressure of the second space may be decreased at the greater rate, since the air is not only sucked, but also released from, the second space. According to the fourth feature (4), the releasing of the adhesive can more quickly be stopped than in the case where the second space were communicated with the atmosphere only. The pressure-decreasing device may be provided by, e.g., a check valve, a suction device, and a pressure-control-state switch device which will be described below. However, in the case where, during at least a portion of the time duration in which the pressure control device is switched from the pressing state to the non-pressing state, the suction device sucks, from the second space, the amount of air which is larger than the amount of air which would be released from the second space to the atmosphere if the second space were communicated with the atmosphere only, the pressure-decreasing device may be provided by the suction device and the pressure-control-state switch device.

(5) According to a fifth feature of the present invention which includes any of the first to fourth features (1) to (4), the adhesive dispenser comprises the pressure control device, and the pressure control device comprises means for controlling a pressure in the second space such that while the pressure control device is in the sucking state, the pressure of the second space takes a negative pressure. In the case where the second space is communicated with the atmosphere only, the pressure of the second space cannot be decreased to a value lower than the atmospheric pressure. However, if the air is sucked from the second space, the pressure of the second space can be decreased to a value lower than the atmospheric pressure. If the pressure of the second space can be decreased to a value lower than the atmospheric pressure, the releasing of the adhesive from the nozzle can be stopped with high reliability, and accordingly the accuracy of control of the amount of adhesive applied to each object can be improved. In addition, in the non-releasing state in which the adhesive is not pressed, and is not released from the nozzle, i.e., is not applied to each object, the adhesive is effectively prevented from "swelling" downward from the level of the lower end of the nozzle. In this respect, too, the amount of adhesive applied to each object can be controlled with improved accuracy. More specifically described, in the case where the second space is communicated with the atmosphere only, the adhesive present at the lower end of the nozzle is subjected to a pressure which is higher than the atmospheric pressure by a value corresponding to the height of the adhesive stored in the reservoir. Therefore, the adhesive at the lower end of the nozzle swells downward to a level where the surface tension of the adhesive at the lower end of the nozzle balances the pressure corresponding to the height of the adhesive stored in the reservoir. This swelling of the adhesive at the lower end of the nozzle leads to lowering the accuracy of control of the amount of adhesive applied to each object. However, if the pressure of the second space is lower than the atmospheric pressure, the amount of swelling of the adhesive from the lower end of the nozzle can be reduced, or even zeroed, leading to improving the accuracy of control of the amount of adhesive applied. For example, if in the non-pressing state the pressure of the second space is held at a negative value corresponding to the height of the adhesive stored in the reservoir, the lower surface of the adhesive present at the lower end of the nozzle becomes flash with the surface of the lower end of the nozzle. If the pressure control device is maintained for a predetermined time in the pressing state following the non-pressing state, the adhesive is applied to an object with an accurately controlled amount.

(6) According to a sixth feature of the present invention which includes any of the first and third to fifth features (1) and (3) to (5), the adhesive dispenser comprises the adhesive-temperature control device, and the adhesive-temperature control device comprises, as the first space, a fluid passage which at least partly surrounds at least the portion of the supply passage; and a fluid-temperature control device which controls a temperature of the fluid supplied to the fluid passage, at a predetermined value. If the fluid having the predetermined temperature is supplied to the fluid passage, the temperature of the adhesive present in the supply passage becomes substantially equal to the predetermined value. The temperature of the fluid supplied to the fluid passage is controlled by the fluid-temperature control device. The fluid passage may surround not only the supply passage but also the reservoir. In the latter case, too, the temperature of the adhesive can be controlled to the predetermined value in a shorter time than that in which the temperature of an entire space inside a cover member which covers an entirety of a known adhesive dispenser can be controlled. In addition, according to the sixth feature (6), less energy is needed to control the temperature of the adhesive to the predetermined value, and accordingly the enlarging of the size of the adhesive dispenser can be avoided. The fluid passage may comprise a passage which fully surrounds at least the portion of the supply passage.

(7) According to a seventh feature of the present invention which includes any of the second to fifth features (2) to (5), the air passage comprises a passage which fully surrounds at least the portion of the supply passage. The fully surrounding passage may be an annular passage, or a spiral or helical passage.

(8) According to an eighth feature of the present invention which includes any of the second to fifth and seventh features (2) to (5) and (7), the air heater comprises an electric heater which heats the air, and wherein the air-heater control device comprises electric-heater control means for controlling the electric heater. The electric heater of the air heater heats the air up to an appropriate temperature. The electric-heater control means controls the electric heater to change the temperature of the air to any desired value. The fluid-temperature control device according to the sixth feature (6) may be provided by the air heater including the electric heater, and the electric-heater control means, each according to the eighth feature (8), and the air cooler according to the second feature (2).

(9) According to a ninth feature of the present invention which includes any of the second to fifth, seventh, and eighth features (2) to (5), (7) and (8), the air supply device comprises an air source which supplies the air, and a heating-and-cooling switch device which is switchable to a heating position in which the switch device permits the air to be supplied from the air source to the air heater and to a cooling position in which the switch device permits the air to be supplied from the air source to the air cooler. If the heating-and-cooling switch device is switched to the heating position, the switch device permits the air to be supplied from the air source to the air heater and, if it is switched to the cooling position, the switch device permits the air to be supplied from the air source to the air cooler. The air cooled by the air cooler is then heated by the air heater. The heating-and-cooling switch device may comprise a solenoid-operated valve device. The air source may be provided by a pressurized-air supply device which is commonly provided in a factory, or an exclusive blower which supplies the ambient air.

(10) According to a tenth feature of the present invention which includes any of the second to fifth, seventh, and eighth features (2) to (5), (7), and (8), the air supply device comprises a heating-and-cooling switch device which is switchable to a heating position in which the switch device permits the air heated by the air heater to be supplied to the air passage and to a cooling position in which the switch device permits the air heated by the air heater to be supplied to the air cooler. In the case where the air cooler is one which cools the air supplied thereto such that the temperature of the air is decreased by a predetermined value, the air which has been heated by the air heater may be supplied to the air cooler so that the air having an appropriate temperature not higher than that of the atmosphere may be supplied to the air passage.

(11) According to an eleventh feature of the present invention which includes any of the first and third to fifth features (1) and (3) to (5), the adhesive dispenser comprises the adhesive-temperature control device, and the adhesive-temperature control device comprises, as the first space, an air passage which at least partly surrounds at least the portion of the supply passage; at least one of (a1) a low-temperature-air supply device which includes an air cooler and which supplies, as the fluid, an air cooled by the air cooler and (a2) a high-temperature-air supply device which includes an air heater and which supplies, as the fluid, an air heated by the air heater; and at least one of (a3) an air supply control device which controls the suppling to the air passage of the air supplied from the at least one of the low-temperature-air supply device and the high-temperature-air supply device and (a4) an air-temperature control device which controls at least one of the air cooler and the air heater which corresponds to the at least one of the low-temperature-air supply device and the high-temperature-air supply device. According to the eleventh feature (11), the adhesive-temperature control device may comprise both, or only one, of the low-temperature-air supply device and the high-temperature-air supply device, or may comprise both, or only one, of the air supply control device and the air-temperature control device. The air-supply control device may be one which controls the suppling to the air passage of the air supplied from either one of the low-temperature-air supply device and the high-temperature-air supply device; one which mixes the air supplied from the low-temperature-air supply device and the air supplied from the high-temperature-air supply device, with each other, and supplies the mixed air to the air passage; or one which mixes the air supplied from either one of the low-temperature-air supply device and the high-temperature-air supply device, with the ambient air, and supplies the mixed air to the air passage. The air-temperature control device may be one which controls both, or only one, of the air cooler and the air heater. Alternatively, the air-temperature control device may be one which controls the temperature of the air supplied to the air passage to a target value, or one which just controls the increasing or decreasing of the temperature of the air. In the latter case, for example, the temperature of the adhesive present in the supply passage or the amount of adhesive actually applied to an object is measured and, if the measured value is different from a target value, the temperature of the air supplied to the air passage is decreased, or increased, so as to reduce, at any rate, the difference between the two values. In the latter case, the temperature of the air before being supplied to the air passage is irrelevant to the matter. In the case where the air-supply control device mixes the air supplied from the low-temperature-air supply device and the air supplied from the high-temperature-air supply device, with each other, at a variable ratio, and supplies the mixed air to the air passage, the mixed air may have an appropriate temperature and accordingly the adhesive present in the supply passage may have an appropriate temperature. For example, even if the air from the low-temperature-air supply device and the air from the high-temperature-air supply device can take only one predetermined temperatures, respectively, that is, even if the air heater and the air cooler may be ones which cannot be controlled by the air-supply control device, the control device can control the temperature of the mixed air to an appropriate value. Meanwhile, in the case where the air-temperature control device controls at least one of the air heater and the air cooler, the air-supply control device can control the temperature of the mixed air to an appropriate value by mixing the air from the low-temperature-air supply device and the air from the high-temperature-air supply device with each other at a predetermined ratio that is not a variable one. Also in the case where the air-supply control device mixes the air supplied from either one of the low-temperature-air supply device and the high-temperature-air supply device, with the ambient air, it can control the temperature of the mixed air to an appropriate value, if at least one of a ratio at which the two airs are mixed and the temperature of the air supplied. In the case where the air-temperature control device controls either one of the air cooler and the air heater, it can control the temperature of the air supplied to the air passage, to an appropriate value, even if the air passage may be supplied with only the air from one of the low-temperature-air supply device and the high-temperature-air supply device which corresponds to the one of the cooler and the heater which is controlled. That is, even if the ratio at which the air from the low-temperature-air supply device and the air from the high-temperature-air supply device are mixed with each other may be 1 to 0, or 0 to 1, the air-temperature control device can control the temperature of the air supplied to the air passage, to an appropriate value. The air-supply control device may be adapted to operate for supplying, to the air passage, only the air from the low-temperature-air supply device, only the air from the high-temperature-air supply device, or only the ambient air, when appropriate. In this case, too, the air-supply control device can control the temperature of the adhesive present in the supply passage, to an appropriate value. In this case, the air passage is supplied with the heated air, the cooled air, or the ambient air and is not supplied with an air having an appropriate temperature. Moreover, also in the case where the air-temperature control device controls only the ON and OFF switching of the air cooler and/or the air heater, it can control the temperature of the adhesive present in the supply passage, to an appropriate value. In this case, too, the air passage is not supplied with an air having an appropriate temperature. The high-temperature-air supply device according to the eleventh feature (11) may be provided by the air heater and the air supply device according to the second feature (2), and the low-temperature-air supply device according to the eleventh feature (11) may be provided by the air cooler, the air heater, and the air supply device according to the second feature (2).

(12) According to a twelfth feature of the present invention which includes any of the first, third to fifth, and eleventh features (1), (3) to (5), and (11), the adhesive dispenser comprises the adhesive-temperature control device, and the adhesive-temperature control device comprises, as the first space, an air passage which at least partly surrounds at least the portion of the supply passage; at least one of (a1) a low-temperature-air supply device which supplies, as the fluid, an air whose temperature is lower than a temperature of an ambient air and (a2) a high-temperature-air supply device which supplies, as the fluid, an air whose temperature is higher than a temperature of an ambient air; and an air supply control device which controls the suppling to the air passage of the air supplied from the at least one of the low-temperature-air supply device and the high-temperature-air supply device.

(13) According to a thirteenth feature of the present invention which includes the eleventh or twelfth feature (11) or (12), the air supply control device comprises an air mixing device which mixes the air supplied from the low-temperature-air supply device and the air supplied from the high-temperature-air supply device with each other, and means for changing a ratio at which the air mixing device mixes, and thereby changing the temperature of the adhesive stored in the reservoir. In the case where at least one of the low-temperature-air supply device and the high-temperature-air supply device includes a flow-amount regulator which regulates an amount of air flowing out therefrom per unit time, the air mixing device may be provided by a flow-amount-regular control device which controls the flow-amount regulator and an air mixer which mixes the air from the low-temperature-air supply device and the air from the high-temperature-air supply device into a single air flow. On the other hand, in the case where neither of the two supply devices includes any flow-amount regulator, the air mixing device may be provided by an air mixer which mixes the two airs at a changeable ratio and means for changing the changeable ratio to a desired one. In the latter case, if each of the low-temperature-air supply device and the air from the high-temperature-air supply has the function of controlling the temperature of air flowing out therefrom, it is possible to return an excessive amount of air to each supply device. On the other hand, if not, the excessive amounts of air may be released into the atmosphere.

(14) According to a fourteenth feature of the present invention which includes the eleventh or twelfth feature (11) or (12), the air supply control device comprises at least one of (a3) a first air mixing device which mixes the air supplied from the low-temperature-air supply device and the ambient air with each other and (a4) a second air mixing device which mixes the air supplied from the high-temperature-air supply device and the ambient air with each other; and means for changing at least one of a first ratio at which the first air mixing device mixes and a second ratio at which the second air mixing device mixes, and thereby changing the temperature of the adhesive stored in the reservoir. According to the fourteenth feature (14), the air supply control device may include both, or only one, of the first and second air mixing devices. In the case where the air supply control device includes the first air mixing device, the first air mixing device supplies the mixed air whose temperature is between the temperature of the air supplied from the low-temperature-air supply device and the temperature of the ambient air, that is, not higher than the temperature of the ambient air; and in the case where the air supply control device includes the second air mixing device, the second air mixing device supplies the mixed air whose temperature is between the temperature of the air supplied from the high-temperature-air supply device and the temperature of the ambient air, that is, not lower than the temperature of the ambient air.

(15) According to a fifteenth feature of the present invention which includes any of the first to sixth features (1) to (6), the adhesive dispenser comprises the adhesive-temperature control device, and the adhesive-temperature control device comprises an air passage which at least partly surrounds at least the portion of the supply passage; at least one of (a1) an air cooler which cools an air as the fluid and (a2) an air heater which heats an air as the fluid; an air supply device which supplies, to the air passage, the air which has flown through the at least one of the air cooler and the air heater; an air-temperature control device which controls the at least one of the air cooler and the air heater. According to the fifteenth feature (15), the air passage may be supplied with the air which has been cooled by the air cooler and heated by the air heater, the air which has been cooled by the air cooler but not heated by the air heater, or the air which has been heated by the air heater but not cooled by the air cooler. In the case where the air passage is supplied with the air which has flown through either one of the air heater and the air cooler, the air-temperature control device can control the temperature of the air supplied to the air passage, by controlling that one of the air cooler and the air heater. Meanwhile, in the case where the air passage is supplied with the air which has flown through both the air cooler and the air heater, the air-temperature control device can control the temperature of the air supplied to the air passage, by controlling both, or only one, of the air cooler and the air heater. For example, in the case where the air passage is supplied with the air which has been cooled by the air cooler and then heated by the air heater, the air-temperature control device can control the heated air to an appropriate temperature not higher than the temperature of the ambient air, by controlling only the air heater.

(16) According to a sixteenth feature of the present invention which includes any of the first to fifteenth features (1) to (15), the adhesive dispenser comprises the pressure control device, and the pressure control device comprises an air source which supplies a pressurized air; a suction device which sucks an air; and a pressure-control-state switch device which is switchable to an air-source communicating position in which the switch device communicates the air source with the second space above the adhesive stored in the reservoir and to a suction-device communicating position in which the switch device communicates the suction device with the second space. If the pressure-control-state switch device is switched to the air-source communicating position, the pressure control device is placed in its pressing state in which the second space is supplied with the pressurized air supplied from the air source; and if it is switched to the suction-device communicating position, the pressure control device is placed in its sucking state in which the suction device sucks the air from the second space. The pressure-control-state switch device may comprise a solenoid-operated valve device.

(17) According to a seventeenth feature of the present invention which includes the sixteenth feature (16), the pressure control device further comprises a check valve which permits an air to flow from the second space into an atmosphere and inhibits an air from flowing from the atmosphere into the second space, and wherein the pressure-control-state switch device which is switchable to a check-valve communicating position in which the switch device communicates the check valve with the second space. If the pressure in the second space (more strictly, the pressure on the second-space side of the check valve) is higher than the atmospheric pressure in the state in which the pressure-control-state switch device is in the check-valve communicating position, the air is released from the second space via the check valve; on the other hand, if the pressure of the second space is lower than the atmospheric pressure, the check valve inhibits the ambient air from from flowing into the second space. In the case where the pressure-control-state switch device is switched to the suction-device communicating position and simultaneously to the check-valve communicating position, the second space is communicated with the suction device and the check valve. In this case, just after the switching of the switch device, that is, during a time duration in which the pressure of the second space is higher than the atmospheric pressure, the air is sucked from the second space by the sucking device and is released from the same into the atmosphere via the check valve. Accordingly, the pressure of the second space is quickly decreased. In this case, however, if there is no check valve between the second space and the atmosphere, the pressure of the second space cannot be decreased down to a value lower than the atmospheric pressure, even if the second space is communicated with the suction device. According to the seventeenth feature (17), the pressure control device can control the pressure of the second space to a value lower than the atmospheric pressure, since the check valve is provided.

(18) According to an eighteenth feature of the present invention which includes the sixteenth feature (16) or the seventeenth feature (17), the pressure control device further comprises an air restrictor which restricts an air flowing from an atmosphere into the second space, and wherein the pressure-control-state switch device which is switchable to an air-restrictor communicating position in which the switch device communicates the air restrictor with the second space. The air restrictor may take any construction so long as its opening to the atmosphere has a cross-section area smaller than that of the reservoir. The cross-section area of the opening may be fixed or variable. For example, the air restrictor may be provided by a throttle valve or a filter. In the state in which the pressure-control-state switch device is in the air-restrictor communicating position, an amount of air restricted by the restrictor is supplied from the atmosphere into the second space. For example, in the case where the pressure-control-state switch device is switched to the suction-device communicating position and simultaneously to the air-restrictor communicating position, the second space is communicated with the suction device and the air restrictor. In this case, at least one of the flow-out amount of air sucked from the second space by the sucking device and the flow-in amount of air supplied to the second space through the air restrictor can be prescribed so that the flow-out amount of air sucked from the second space and the flow-in amount of air supplied to the second become equal to each other when the pressure of the second space takes a prescribed value. In this case, the pressure of the second space can be maintained at substantially the prescribed value. The reason why the switch device is switched to the suction-device communicating position and simultaneously to the air-restrictor communicating position is that in this state the pressure of the second space can easily be maintained at substantially the prescribed value and that in this state the air is circulated in the second space, which contributes to preventing the temperature of the air from excessive increase.

(19) According to a nineteenth feature of the present invention which includes any of the third to eighteenth feature (3) to (18), the pressure control device comprises a pressure maintaining device which maintains, in a non-pressing state comprising at least one of the sucking state and the gas-releasing state, a pressure in the second space at about a predetermined value not higher than an atmospheric pressure. In the case where the flow-out amount of air sucked by the suction device from the second space is changeable and the pressure control device comprises flow-out-amount changing means for changing the flow-out amount of air so that the pressure of the second space may be maintained at a prescribed negative value, the pressure maintaining device may be provided by the suction device and the flow-out-amount changing means. On the other hand, in the case where the flow-out amount is fixed at a constant value irrespective of the current pressure of the second space, the pressure maintaining device may be provided by the above-described air restrictor and the suction device. Since the pressure of the second space can be maintained at the predetermined value not higher than the atmospheric pressure when the pressure control device is in the non-pressing state, the releasing of the adhesive from the nozzle can be stopped with high reliability and air bubbles are prevented from occurring in the adhesive stored in the reservoir.

(20) According to a twentieth feature of the present invention which includes any of the first to nineteenth feature (1) to (19), the adhesive dispenser comprises both the adhesive-temperature control device and the pressure control device, and further comprises a gas source which supplies, as the fluid, a pressurized gas to each of the adhesive-temperature control device and the pressure control device. In this case, the gas from the gas source is commonly used for being supplied to the first and second spaces. With this arrangement, the production cost of the adhesive dispenser is accordingly reduced. Although the gas source may be one which is exclusive for the adhesive dispenser, it may be one which is used commonly for an object moving device which transfers, and/or moves up and down, objects to which the adhesive is applied by the adhesive dispenser. Alternatively, the adhesive dispenser may be connected to a connector or a tap which is connected to a high-pressure source which supplies a pressurized air throughout a factory. In the latter cases, the production cost of the adhesive dispenser is further reduced.

(21) According to a twenty-first feature of the present invention, there is provided an adhesive dispenser for iteratively dispensing a controlled amount of an adhesive from a reservoir therefor, by iteratively applying a pressure to the adhesive stored in the reservoir such that the controlled amount of adhesive is released from a nozzle connected to the reservoir via a supply passage and is applied to an object, the adhesive dispenser comprising at least one of (A) an adhesive-temperature control device which controls a temperature of the adhesive present in the supply passage, by supplying a fluid having a controlled temperature to a space at least partly surrounding at least a portion of the supply passage, and (B) a pressure control device which is switchable to a pressing state thereof in which the pressure control device increases a pressure applied to the adhesive stored in the reservoir, to a value higher than an atmospheric pressure and a sucking state thereof in which the pressure control device decreases the pressure applied to the adhesive stored in the reservoir, to a value not higher than the atmospheric pressure.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
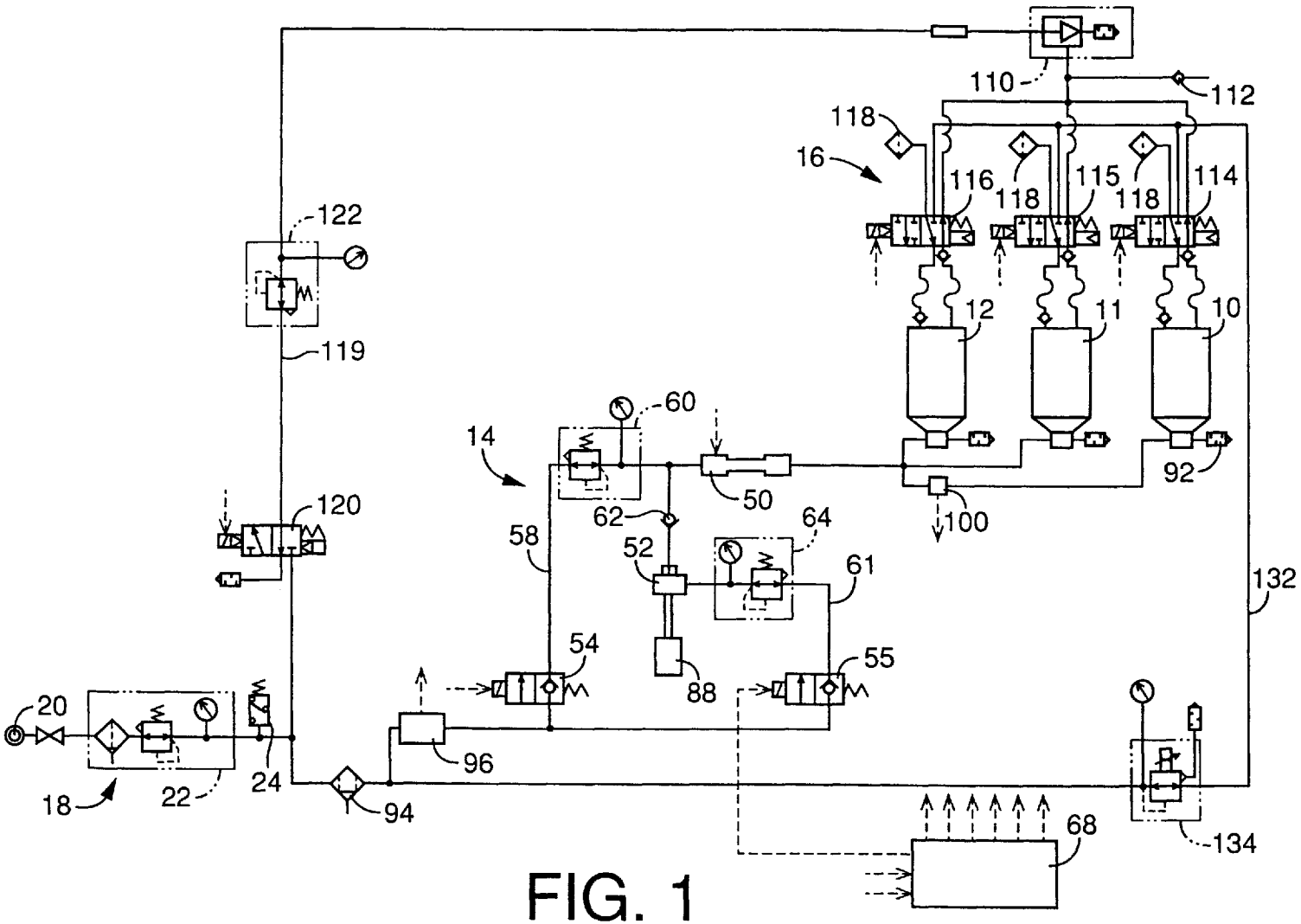
FIG. 1 is a diagram showing an overall circuit of an adhesive dispenser embodying the present invention.
Figure 2:
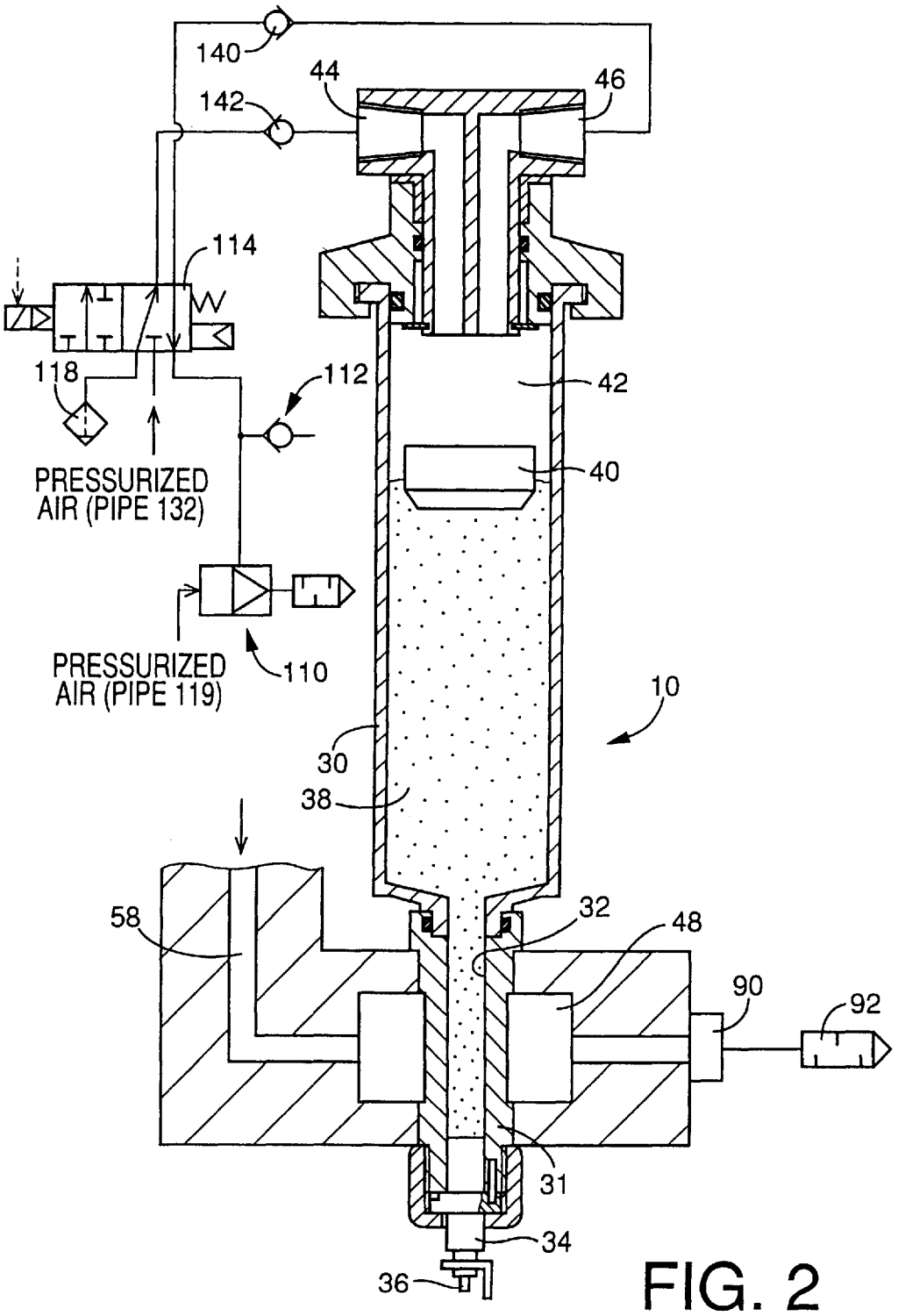
FIG. 2 is a cross-section view of an adhesive applying head of the adhesive dispenser of FIG. 1.
Figure 3:
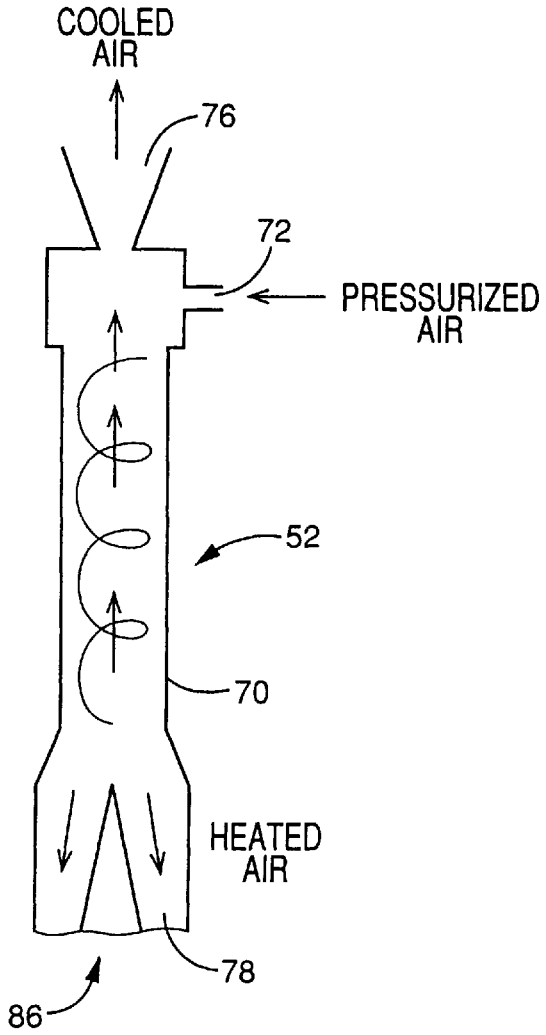
FIG. 3 is an illustrative view of a vortex tube employed in the adhesive dispenser of FIG. 1.

Referring to FIGS. 1, 2, and 3, there will be described an adhesive dispenser embodying the present invention.

In FIG. 1, reference numerals 10, 11, 12 designate a first, a second, and a third adhesive applying heads, respectively; reference numeral 14 designates an adhesive-temperature ("AT") control device; and reference numeral 16 designates a pressure ("P") control device. The AT control device 14 and the P control device 16 have a common pressurized-air supply device 18, which supplies a pressurized air to each of the two control devices 14, 16.

The pressurized-air supply device 18 includes a high-pressure air source 20, an air-pressure regulator 22, a pressure switch 24, etc. The air-pressure regulator 22 includes a pressure-decrease valve with a relief member. In the present embodiment, the air-pressure regulator 22 regulates the pressurized air supplied from the high-pressure air source 20, to 0.5 MPa. The pressure switch 24 opens when the air pressure exceeds a predetermined value, e.g., 0.5 MPa. The supply device 18 supplies the pressurized air additionally to an object moving device (not shown) which feeds in and out, and lifts up and down, objects (not shown) to which adhesive is applied by the adhesive applying heads 10–12.

FIG. 2 shows the first adhesive applying head 10 as a representative of the first to third heads 10, 11, 12 which have the same construction. The first head 10 has a syringe 30, and a nozzle 34 which is connected via a supply passage 32 of a connector pipe 31 to a lower end portion of the syringe 30. A spout pipe 36 is attached to the nozzle 34. An adhesive 38 is stored in the syringe 30, and a float 40 floats on an upper surface of the adhesive 38 stored in the syringe 30, for detecting a remaining amount of the adhesive 38. An air supply passage 44 and an air suction passage 56 are connected to a space 42 above the float 40 in the syringe 30.

An axially intermediate portion of the supply passage 32, that is, an axially intermediate portion of the connector pipe 31 is surrounded by an annular passage 48 as an air passage. The annular passage 48 is supplied with an air whose temperature has been controlled to a desired value in a manner described later. In the present embodiment, the temperature of the adhesive 38 present in the supply passage is controlled by controlling the temperature of the air supplied to the annular passage 48.

The AT control device 14 includes, in addition to the pressurized-air supply device 18 and the annular passage 48, an in-line heater 50 as an air heating device, a vortex tube 52, solenoid-operated valves 54, 55, etc.

A piping 58 is connected at its one end to the pressurized-air supply device 18 and at its other end to the annular passage 48. In the piping 58, there are provided the in-line heater 50, a heater-pressure regulator 60, and the solenoid-operated valve 54 in series. The pressurized air of the supply device 18 is supplied to the in-line heater 50 after the air pressure has been decreased to a predetermined heater pressure (in the present embodiment, 0.04 MPa) by the heater-pressure regulator 60. A piping 61 connects the supply device 18 and the in-line heater 50, by by-passing the heater-pressure regulator 60 and the solenoid-operated valve 54. In the piping 61, there are provided a check valve 62, the vortex tube 52, a cooler-pressure regulator 64, and the solenoid-operated valve 54 in series.

Thus, the in-line heater to which the heater-pressure regulator 60 and the vortex tube 52 are connected is supplied with an air whose temperature is substantially equal to that of the ambient air, or an air which has been cooled by the vortex tube 52.

The in-line heater 50 heats the air supplied thereto, to a temperature corresponding to a command from a control device 68 which will be described later. The air heated by the in-line heater 50 is supplied to the annular passage 48. When the air whose temperature is substantially equal to that of the ambient air is supplied to the heater 50, the annular passage 48 is supplied with an air whose temperature is not lower than that of the ambient air; on the other hand, when the air which has been cooled by the vortex tube 52 is supplied to the heater 50, the annular passage 48 is supplied with an air whose temperature is between the temperature of the cooled air and the temperature of the ambient air, i.e., is lower than the temperature of the ambient air. Thus, the annular passage 48 can be supplied with the air whose temperature is, or is not, lower than that of the ambient air. Thus, the temperature of the adhesive 38 can be controlled at values not lower than that of the ambient air, or values lower than that of the ambient air.

As shown in FIG. 3, the vortex tube 52 has a generally cylindrical shape, and has a compressed-air inlet 72 which is provided in one end portion of a main body 70 thereof. The tube 52 has a cooled-air outlet 76 at one end thereof, and a heated-air outlet 78 at the other end thereof. The cooler-pressure regulator 64 is connected to the compress-air inlet 72 via the piping 61, and the heated-air outlet 76 is connected to the in-line heater 50 via the check valve 62. A valve device 86 is provided in the heated-air outlet 78, so that the area of opening of the heated-air outlet 78 can be changed by operating the valve device 86. As the area of opening of the outlet 78 decreases, the amount of the cooled air supplied from the cooled-air outlet 76 increases but the temperature of the cooled air increases. A silencer 88 (FIG. 1) is connected to the heated-air outlet 78, so as to reduce noise which is generated when the heated air is released into the ambient air.

The compressed air which has passed the compressed-air inlet 72 expands in the main body 70 and moves downward like a vortex, so that a portion of the air is released via the heated-air outlet 78 and the remaining air moves upward through a central portion of the main body and passes through the cooled-air outlet 76.

Each of the solenoid valves 54, 55 is switchable to a communication position in which each valve communicates the supply device 18 and the in-line heater with each other, and a shut-off position in which each valve does not. Each valve 54, 55 is switched by a drive circuit (not shown) in response to a command from the control device 68.

While both the solenoid valves 54, 55 are in their initial positions shown in FIG. 1, that is, while an operation for applying the adhesive 38 to objects is not carried out, no air is supplied to the annular passage 48.

While the valve 54 is in its communication position and the valve 55 is its shut-off position, the in-line heater 50 is supplied with the air which is supplied from the heater-pressure regulator 60 and whose temperature is substantially equal to that of the ambient air. The heater 50 heats the air to a desired temperature not lower than that of the ambient air, and supplies the heated air to the annular passage 48. The annular passage 48 is supplied with the air whose temperature has been controlled to the desired temperature not lower than that of the ambient air. Thus, the temperature of the adhesive 38 present in the supply passage 32 is controlled to be substantially equal to that of the air present in the passage 48. The air supplied to the annular passage 48 is released into the atmosphere via an outlet 90 provided with a silencer 92. Hereinafter, this state in which only the air which has flown through only the in-line heater 50 is supplied to the annular passage 48 but no air which has flown through the vortex tube 52 is supplied to the same 48, will be referred to as the "heated-air supplying state".

In the heated-air supplying state, the check valve 62 provided in the piping 61 prevents the air supplied from the heater-pressure regulator 60 to the in-line heater 50, from flowing into the vortex tube 52 through the cooled-air outlet 76 thereof. If the air would flow into the vortex tube 52 through the cooled-air outlet 76, it would directly flow out of the heated-air outlet 78, thereby decreasing the overall amount of air supplied to the in-line heater 50 or the annular passage 48.

While the solenoid valve 54 is in its shut-off position and the solenoid valve 55 is its communication position, the vortex tube 52 is supplied with the compressed air whose pressure has been regulated by the cooler-pressure regulator 64. The vortex tube 52 decreases the temperature of the air supplied thereto, by about 20° C., and the cooled air is supplied to the in-line heater 50 via the cooled-air outlet 76. The heater 50 heats the cooled air up to a desired temperature, and the heated air is supplied to the annular passage 48. Thus, the temperature of the air supplied to the annular passage 48 can take any desired value between the temperature of the ambient air and the temperature lower by about 20° C. than the ambient-air temperature, that is, value lower than the ambient-air temperature. Therefore, the temperature of the adhesive 38 can be controlled to any desired value lower than the ambient-air temperature.

In the above-indicated state, the heater-pressure regulator 60 prevents, like the check valve 62, the air supplied to the in-line heater 50 via the piping 61, from flowing into the solenoid valve 54. Hereinafter, this state in which only the air which has flown both the vortex tube 52 and the in-line heater 50 is supplied to the annular passage 48 but no air which has flown through only the in-line heater 50 is supplied to the same 48, will be referred to as the "cooled-air supplying state".

In the present embodiment, the pressurized-air supply device 18, the solenoid valves 54, 55, the pipings 58, 61, etc. cooperate with one another to provide an air supplying device.

In the piping 58, there are provided a filter 94 and a temperature sensor 96 between the supply device 18 and the solenoid valve 54. The filter 94 removes oil, dust, dirt, etc. from the air supplied from the supply device 18, and the temperature sensor 96 measures the temperature of the air before the air temperature is controlled, that is, the temperature of the air as supplied from the supply device that is substantially equal to the ambient-air temperature. In the piping 58, another temperature sensor 100 is provided between the in-line heater 50 and the annular passage 48. This temperature sensor 100 measures the temperature of the air after the air temperature has been controlled, that is, the temperature of the air as supplied to the annular passage 48. The respective output signals of the two sensors 96, 100 are supplied to the control device 68.

The P control device 16 which controls the pressure of the space 42 above the adhesive 38 stored in the syringe 30 of the applying head 10 includes, in addition to the pressurized-air supply device 18, an aspirator 110, a check valve 112, three solenoid-operated valves 114, 115, 116 provided for the three heads 10, 11, 12, respectively, a filter 118, etc. In the following description, the valve 114 will be described as a representative of the three valves 114, 115, 116.

The aspirator 110 is a suction device which utilizes a pressure difference caused by air flow, and is employed for sucking air from the space 42 above the adhesive 38 stored in the head 10. The aspirator 110 has an air inlet which is connected via a piping 119 to the pressurized-air supply device 18. In the piping 119, there are provided a solenoid-operated valve 120, a suction-pressure regulator 122, etc.

The solenoid valve 120 is switchable to a release position in which the valve 120 communicates the air inlet of the aspirator 110 with the atmosphere, and to a connect position in which the valve 120 communicates the air inlet of the aspirator 110 with the supply device 18. While the valve 120 is normally in its release position shown in FIG. 1, it is switched to its connect position at least while the aspirator 110 is operating. Thus, the pressurized air is supplied from the supply device 18 via the valve 120 to the suction-pressure regulator 122, which decreases the pressure of the air. This air is supplied to the aspirator 110. The higher the pressure of the air regulated by the regulator 122 is, the greater the pressure difference which occurs in the aspirator 110 is, and the greater the amount of air sucked by the aspirator 110 is.

The check valve 112 permits the air in the space 42 to be released into the atmosphere when the pressure on the side of the solenoid valve 114, that is, the pressure of the space 42 is higher than the atmospheric pressure, and the valve 112 inhibits air from flowing from the atmosphere into the space 42 when the pressure of the space 42 is lower than the atmospheric pressure. The check valve 112 is connected to the space 42, in parallel with the aspirator 110.

The filter 118 serves as a restrictor which decreases the amount of air flowing from the atmosphere into the space 42. This flow-in amount of air is substantially equal to the flow-out amount of air sucked from the space 42 by the aspirator 110, when the pressure of the space 42 takes a predetermined negative pressure.

The solenoid valve 114 is connected to the supply device 118, the air inlet of the aspirator 110 and the check valve 112, the filter 118, the air-supply passage 44 connected to the space 42, and the air-suction passage 46. The valve 114 and the supply device 18 are connected to each other via a piping 132, and an application-pressure regulator 134 is provided in the piping 132. The pressurized air whose pressure has been regulated by the regulator 134 is supplied to the space 42 for applying a positive pressure to the adhesive 38 and thereby spouting a desired amount of adhesive 38 from the head 10.

A check valve 140 is provided between the solenoid valve 114 and the air-suction passage 46, and another check valve 142 is provided between the solenoid valve 114 and the air-supply passage 44. The check valve 140 permits the air to flow from the space 42 to the valve 114 and inhibits the air from flowing from the valve 114 to the space 42, and the check valve 142 permits the air to flow from the valve 114 to the space 42 and inhibits the air from flowing from the space 42 to the valve 114. The check valves 140, 142 are employed for preventing the air from flowing back, so that the air appropriately circulates in the space 42.

The solenoid valve 114 is normally in its suction position (i.e., non-application position) shown in FIGS. 1 and 2. In this position, the air-suction passage 46 is connected to the air-supply inlet of the aspirator 110 and the check valve 112, and the air-supply passage 44 is connected to the filter 118. If the valve 114 is switched to its press position (i.e., application position), the air-supply passage 44 is connected via the piping 132 to the supply device 18, and the air-suction passage 46 is disconnected from the aspirator 110 and the check valve 112.

While the solenoid valve 114 is in its press position, the space 42 is supplied with the pressurized air whose pressure has been regulated by the application-pressure regulator 134, as described above. When the pressure of the space 42 increases, the adhesive 38 is pressed, and spouted from the head 10. Hereinafter, this state will be referred to as the "adhesive pressing" state.

When the solenoid valve 114 is switched to its suction position, the space 42 is communicated with the air inlet of the aspirator 110, the filter 118, and the atmosphere via the check valve 112. For a while following this switching, the pressure of the space 42 is higher than the atmospheric pressure. Accordingly, the air in the space 42 is released into the atmosphere via the check valve 112, and is sucked by the aspirator 110. Thus, the pressure of the space 42 quickly decreases. This state is the "adhesive sucking" state and simultaneously the "air releasing" state. When the pressure of the space 42 decreases down to a predetermined negative pressure, the flow-out amount of air sucked from the space 42 by the aspirator 110 becomes equal to the flow-in amount of air supplied to the space 42 from the atmosphere via the filter 118, as described above. Therefore, the pressure of the space 42 is held at the predetermined negative pressure. In this state, no air is supplied to the space 42 from the atmosphere via the check valve 112. This state is the "negative-pressure holding" state.

The control device 68 includes a computer as an essential part thereof, and has input ports connected to the temperature sensors 96, 100, etc. and output ports connected to respective solenoids of the solenoid-operated valves 54, 55, 114, 115, 116, 120, a heater element of the in-line heater 50, etc. via respective drive circuits (not shown). The computer has a read only memory (ROM) in which a number of control programs for applying an adhesive to objects are stored. According to the control programs, the control device 68 controls each of the solenoid valves 114–116 so that the adhesive 38 is applied to the object at a predetermined timing, and controls the solenoid valves 54, 55, the in-line heater 50, etc. based on the output signals from the temperature sensors 96, 100, etc. In the present embodiment, when the adhesive 38 is applied to the object, the solenoid valve 120 is held at the connect position in which the valve 120 permits the pressurized air to be supplied to the air-supply inlet of the aspirator 110.

Next, there will be described the operation of the adhesive dispenser constructed as described.

Before the adhesive 38 is applied to the object, the temperature of the adhesive 38 present in the supply passage 38 is controlled to a predetermined value suitable for the application of the adhesive 38. In the case where the predetermined value is higher than the ambient-air temperature detected by the temperature sensor 96, the solenoid valve 54 is switched to its communication position and the vale 55 is held at its shut-off position. Accordingly, the in-line heater 50 is supplied with the air whose temperature is substantially equal to the ambient-air temperature, and heats the air up to the predetermined value. The air heated is supplied to the annular passage 48. Thus, in the case where the temperature, $T_1$, of the air (i.e., ambient-air temperature) is not higher than the predetermined value, $T_0$, that is, in the case of $T_0 \geqq T_1$, the AT control device 14 only heats the air up to the predetermined value $T_0$.

On the other hand, in the case where the predetermined value $T_0$ is lower than the ambient-air temperature $T_1$, the solenoid valve 55 is switched to its communication position and the vale 54 is held at its shut-off position. The air supplied to the vortex tube 52 is cooled down to a value lower by about 20° C. than the ambient-air atmosphere $T_0$, and the air cooled is supplied to the in-line heater 50. The heater 50 heats the air up to the predetermined value $T_0$, and the air heated is supplied to the annular passage 48. Thus, in the case where the air temperature $T_1$ is higher than the predetermined value $T_0$, that is, in the case of $T_0<T_1$, the AT control device 14 cools the air down to a value, $T_2$, lower than the predetermined value $T_0$ ($T_1>T_0>T_2$) and then heats the cooled air up to the predetermined value $T_0$.

In the present embodiment, the annular passage 48 is supplied with the air having the predetermined or desired temperature $T_0$, and accordingly the temperature of the adhesive 38 present in the supply passage 32 is controlled to the predetermined value $T_0$. Thus, the present adhesive dispenser can control the temperature of the adhesive 38 to the predetermined value $T_0$, in a shorter time than the known adhesive dispensers. In addition, the present adhesive dispenser can control the temperature of the adhesive 38 to the predetermined value $T_0$, with less energy than the known adhesive dispensers, without having to increase the overall size thereof.

When the adhesive 38 stored in the syringe 30 is applied to the object, the solenoid valve 114 is switched to its press position. The space 42 is supplied via the piping 132 with the pressurized air whose pressure has been regulated to an application pressure, and an appropriate amount of the adhesive 38 is spouted from the spout pipe 36. Then, the valve 114 is switched to its suction position as shown in FIGS. 1 and 2. Thus, the space 42 is communicated with the filter 118 and the aspirator 110, and simultaneously is communicated with the atmosphere via the check valve 112. The air in the space 42 is sucked by the aspirator 110 and is released into the atmosphere via the check valve 112. As a result, the pressure in the space 42 is quickly decreased, and accordingly the spouting of the adhesive from the spout pipe 36 is quickly stopped. Once the pressure of the space 42 is decreased down to the predetermined negative pressure, the flow-in amount of air supplied from the atmosphere via the filter 118 is substantially equal to the flow-out amount of air sucked by the aspirator 110, so that the pressure of the space 42 is held at the predetermined negative pressure.

Since the pressure in the space 42 is quickly decreased when the valve 114 is switched from its press position to its suction position, the pressure of the space 42 is more quickly decreased down to a value at which the spouting of the adhesive 38 from the head 10 stops, than in the case where the space 42 is just communicated with the atmosphere. That is, the spouting of the adhesive 38 is more quickly stopped. Therefore, the present adhesive dispenser enjoys an improved accuracy of control of the amount of adhesive 38 applied to an object. In addition, since the pressure of the space 42 is held at the predetermined negative pressure, the spouting of the adhesive 38 from the spout pipe 38 is stopped with reliability, and accordingly bubbles do not occur in the adhesive 38 stored in the syringe 30.

As is apparent from the foregoing description, the present adhesive dispenser can control the temperature of the adhesive 38 to a desired value in a shortened time duration, and can quickly stop the spouting or releasing of the adhesive 38 from the spout pipe 36. Thus, the present dispenser enjoys an improved degree of operability with respect to the adhesive applying operation.

Figure 4:
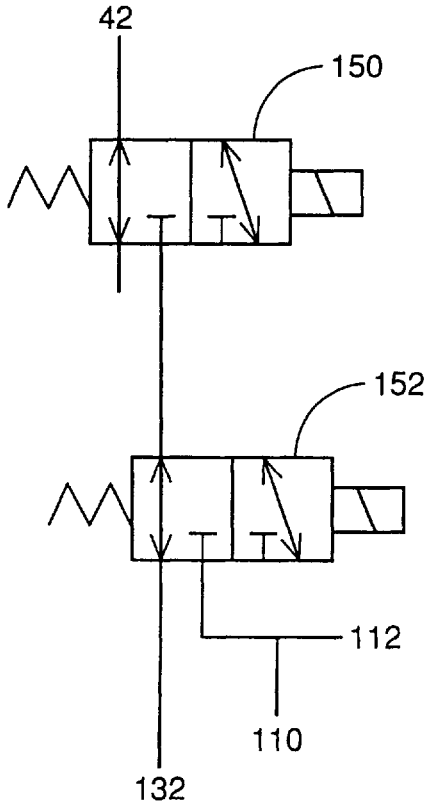
FIG. 4 is an illustrative view of two solenoid-operated valves employed as a switch device in an adhesive dispenser as a second embodiment of the present invention.

FIG. 4 shows a second embodiment of the present invention. The second embodiment also relates to an adhesive dispenser which has a construction similar to that of the first embodiment shown in FIGS. 1 to 3 but is different from the latter in that the second adhesive dispenser includes a first and a second solenoid-operated valve 150, 152 in place of the solenoid-operated valve 114 and the air restrictor 118. The first valve 150 is connected to the space 42 via a single air passage which is provided in place of the two air passages 44, 46 and which has no check valve corresponding to the valves 140, 142 provided in the air passages 44, 46.

In the second embodiment, when the adhesive 38 stored in the syringe 30 of the head 10 is applied to an object, first, the first valve 150 is connected to the pipe 132 via the second valve 152 so as to supply the pressurized air to the space 42 above the adhesive 38, subsequently the second valve 152 is connected to the aspirator 110 and the atmosphere via the check valve 112 so as to suck and release the air from the space 42 and thereby quickly decrease the air pressure in the space 42, then the first valve 150 is returned and connected directly to the atmosphere so as to decrease slowly the pressure of the space 42, and finally the second valve 152 is returned and connected to the pipe 132. A check valve may be provided between the first valve 150 and the atmosphere.

While the present invention has been described in its preferred embodiment, it may be embodied in different manners.

For example, while each of the illustrated adhesive dispensers is equipped with both the adhesive-temperature (AT) control device 14 and the pressure (P) control device 16, either one of the two devices 14, 16 may be omitted. In the latter case, the amount of adhesive applied to each object can be controlled with high accuracy.

In each of the illustrated embodiments, when the solenoid valve 114 is switched to its suction position, the space 42 is communicated with the aspirator 110 and simultaneously is communicated with the atmosphere via the check valve 112. However, in this state, the space 42 may be communicated with the aspirator 110 only, that is, may not be communicated with the atmosphere. Since the aspirator 110 positively sucks the air from the space 42, the pressure of the space 42 is more quickly decreased to a value at which the spouting or releasing of the adhesive 38 stops, than in the case where the space 42 is communicated with the atmosphere only. That is, the spouting of the adhesive 38 is more quickly stopped. In addition, even in the case where the space 42 is communicated with the atmosphere as well as the aspirator 110, it is possible to omit the check valve 112. In the last case, too, the pressure of the space 42 can quickly be decreased and the spouting of the adhesive 38 can quickly be stopped. Moreover, the filter 118 may be omitted, for example, in the case where the aspirator 110 is replaced by a suction device which can control the flow-out amount of air sucked thereby from the space 42, depending upon the current pressure of the space 42. In this case, too, the pressure of the space 42 can easily be held at a predetermined negative pressure.

The space 42 may be supplied with nitrogen gas, inert gas, or the like in place of the air. In this case, the adhesive 38 is effectively prevented from oxidization.

In each of the illustrated embodiments, the annular passage 48 is supplied with the air having the predetermined temperature $T_0$. However, the temperature of the adhesive 38 may be controlled to the predetermined value $T_0$ in a different manner. For example, the heater element (not shown) of the in-line heater 50 may be controlled by the control device 68 so that the temperature of the adhesive 38 may be controlled to the predetermined value $T_0$. In addition, if the amount of adhesive 38 applied to each object can be controlled to the predetermined amount in some manner, that manner can also be said as a manner in which the temperature of the adhesive 38 is controlled to the predetermined value $T_0$.

The annular passage 48 may be supplied with a liquid such as water in place of a gas.

The AT control device 14 may be modified in various manners. For example, the AT control device 14 may additionally include a mixing device which mixes the air supplied from the in-line heater 50 with the air supplied from the vortex tube 52 at a changeable ratio of the former to the latter, and supplies the mixed air to the annular passage 48, or include another mixing device which mixes one of the air supplied from the in-line heater 50 and the air supplied from the vortex tube 52, with the air directly obtained from the atmosphere, at a changeable ratio of the former to the latter, and supplies the mixed air to the passage 48. In each case, the AT control device 14 additionally includes means for changing the ratio. The vortex tube 52 may be replaced by an air cooling device which can cool air down to any desired temperature. In this case, the annular passage 48 may be directly supplied with the cooled air having the desired temperature from the air cooling device, without having to heat the air which has been cooled, up to the desired temperature. In addition, the air cooling device may be provided downstream of an air heating device in the direction in which the pressurized air supplied from the air supply device 18 flows.

Although in each of the illustrated embodiments the pressurized-air supply device 18 is shared by the P control device 16 and the AT control device 14, two exclusive pressurized-air supply devices may be employed for the two devices 16, 14, respectively.

In each of the illustrated embodiments, the pressure in the space 42 is controlled for applying the positive or negative pressure to the adhesive 38 stored in the syringe 30. However, the adhesive 38 may be subjected to a positive and a negative pressure which are directly applied thereto by a piston or the like. This adhesive dispenser is encompassed by the present invention. If the dispenser is equipped with the AT control device 14, it enjoys an improved accuracy of control of the amount of adhesive applied to each object.

It is to be understood that the present invention may be embodied with other changes, improvements, and modifications that may occur to those skilled in the art without departing from the scope and spirit of the invention defined in the appended claims.

What is claimed is:

1. An adhesive dispenser for iteratively dispensing a controlled amount of an adhesive from a reservoir, by iteratively applying a pressure to the adhesive stored in the reservoir such that the controlled amount of adhesive is released from a nozzle connected to the reservoir via a supply passage and is applied to an object, the improvements comprising at least one of (A) an adhesive-temperature control device which controls a temperature of the adhesive present in the supply passage, by supplying a fluid to a first space at least partly surrounding at least a portion of the supply passage, and (B) a pressure control device which is switchable to at least a pressing state thereof in which the pressure control device supplies a pressurized gas to a second space above the adhesive stored in the reservoir and a sucking state thereof in which the pressure control device sucks the gas from the second space.

2. An adhesive dispenser according to claim 1, comprising the adhesive-temperature control device, wherein the adhesive-temperature control device comprises, as the first space, an air passage which at least partly surrounds at least said portion of the supply passage; an air heater which heats an air as the fluid; an air cooler which cools an air; an air supply device which is switchable to a heated-air supply state thereof in which the air supply device supplies, to the air passage, the air which has been heated by the air heater and has not been cooled by the air cooler and to a cooled-air supply state thereof in which the air supply device supplies, to the air passage, the air which has been cooled by the air cooler and has been heated by the air heater; and an air-heater control device which controls the air heater and thereby controls a temperature of the air supplied to the air passage.

3. An adhesive dispenser according to claim 1, comprising the pressure control device, wherein the pressure control device is switchable to a gas-releasing state in which the pressure control device communicates the second space with an atmosphere.

4. An adhesive dispenser according to claim 3, wherein the pressure control device comprises a pressure-decreasing device which decreases a pressure in the second space such that during at least a portion of a time duration in which the pressure control device is switched from the pressing state to a non-pressing state comprising at least one of the sucking state and the gas-releasing state, the pressure of the second space is decreased at a rate greater than a rate at which the pressure of the second space would be decreased if the second space were communicated with an atmosphere only.

5. An adhesive dispenser according to claim 1, comprising the pressure control device, wherein the pressure control device comprises means for controlling a pressure in the second space such that while the pressure control device is in the sucking state, the pressure of the second space takes a negative pressure.

6. An adhesive dispenser according to claim 1, comprising the adhesive-temperature control device, wherein the adhesive-temperature control device comprises, as the first space, a fluid passage which at least partly surrounds at least said portion of the supply passage; and a fluid-temperature control device which controls a temperature of the fluid supplied to the fluid passage, at a predetermined value.

7. An adhesive dispenser according to claim 2, wherein the air passage comprises a passage which fully surrounds at least said portion of the supply passage.

8. An adhesive dispenser according to claim 2, wherein the air heater comprises an electric heater which heats the air, and wherein the air-heater control device comprises electric-heater control means for controlling the electric heater.

9. An adhesive dispenser according to claim 2, wherein the air supply device comprises an air source which supplies the air, and a heating-and-cooling switch device which is switchable to a heating position in which the switch device permits the air to be supplied from the air source to the air heater and to a cooling position in which the switch device permits the air to be supplied from the air source to the air cooler.

10. An adhesive dispenser according to claim 2, wherein the air supply device comprises a heating-and-cooling switch device which is switchable to a heating position in which the switch device permits the air heated by the air heater to be supplied to the air passage and to a cooling position in which the switch device permits the air heated by the air heater to be supplied to the air cooler.

11. An adhesive dispenser according to claim 1, comprising the adhesive-temperature control device, wherein the adhesive-temperature control device comprises, as the first space, an air passage which at least partly surrounds at least said portion of the supply passage; at least one of (a1) a low-temperature-air supply device which includes an air cooler and which supplies, as the fluid, an air cooled by the air cooler and (a2) a high-temperature-air supply device which includes an air heater and which supplies, as the fluid, an air heated by the air heater; and at least one of (a3) an air supply control device which controls the suppling to the air passage of the air supplied from said at least one of the low-temperature-air supply device and the high-temperature-air supply device and (a4) an air-temperature control device which controls at least one of the air cooler and the air heater which corresponds to said at least one of the low-temperature-air supply device and the high-temperature-air supply device.

12. An adhesive dispenser according to claim 1, comprising the adhesive-temperature control device, wherein the adhesive-temperature control device comprises, as the first space, an air passage which at least partly surrounds at least said portion of the supply passage; at least one of (a1) a low-temperature-air supply device which supplies, as the fluid, an air whose temperature is lower than a temperature of an ambient air and (a2) a high-temperature-air supply device which supplies, as the fluid, an air whose temperature is higher than a temperature of an ambient air; and an air supply control device which controls the suppling to the air passage of the air supplied from said at least one of the low-temperature-air supply device and the high-temperature-air supply device.

13. An adhesive dispenser according to claim 12, wherein the air supply control device comprises an air mixing device which mixes the air supplied from the low-temperature-air supply device and the air supplied from the high-temperature-air supply device with each other, and means for changing a ratio at which the air mixing device mixes, and thereby changing the temperature of the adhesive stored in the reservoir.

14. An adhesive dispenser according to claim 12, wherein the air supply control device comprises at least one of (a3) a first air mixing device which mixes the air supplied from the low-temperature-air supply device and the ambient air with each other and (a4) a second air mixing device which mixes the air supplied from the high-temperature-air supply device and the ambient air with each other; and means for changing at least one of a first ratio at which the first air mixing device mixes and a second ratio at which the second air mixing device mixes, and thereby changing the temperature of the adhesive stored in the reservoir.

15. An adhesive dispenser according to claim 1, comprising the adhesive-temperature control device, wherein the adhesive-temperature control device comprises an air passage which at least partly surrounds at least said portion of the supply passage; at least one of (a1) an air cooler which cools an air as the fluid and (a2) an air heater which heats an air as the fluid; an air supply device which supplies, to the air passage, the air which has flown through said at least one of the air cooler and the air heater; an air-temperature control device which controls said at least one of the air cooler and the air heater.

16. An adhesive dispenser according to claim 1, comprising the pressure control device, wherein the pressure control device comprises an air source which supplies a pressurized air; a suction device which sucks an air; and a pressure-control-state switch device which is switchable to an air-source communicating position in which the switch device communicates the air source with the second space above the adhesive stored in the reservoir and to a suction-device communicating position in which the switch device communicates the suction device with the second space.

17. An adhesive dispenser according to claim 16, wherein the pressure control device further comprises a check valve which permits an air to flow from the second space into an atmosphere and inhibits an air from flowing from the atmosphere into the second space, and wherein the pressure-control-state switch device which is switchable to a check-valve communicating position in which the switch device communicates the check valve with the second space.

18. An adhesive dispenser according to claim 16, wherein the pressure control device further comprises an air restrictor which restricts an air flowing from an atmosphere into the second space, and wherein the pressure-control-state switch device which is switchable to an air-restrictor communicating position in which the switch device communicates the air restrictor with the second space.

19. An adhesive dispenser according to claim 3, wherein the pressure control device comprises a pressure maintaining device which maintains, in a non-pressing state comprising at least one of the sucking state and the gas-releasing state, a pressure in the second space at about a predetermined value not higher than an atmospheric pressure.

20. An adhesive dispenser according to claim 1, comprising both the adhesive-temperature control device and the pressure control device, and further comprising a gas source which supplies, as the fluid, a pressurized gas to each of the adhesive-temperature control device and the pressure control device.

21. An adhesive dispenser for iteratively dispensing a controlled amount of an adhesive from a reservoir therefor, by iteratively applying a pressure to the adhesive stored in the reservoir such that the controlled amount of adhesive is released from a nozzle connected to the reservoir via a supply passage and is applied to an object, the improvements comprising at least one of (A) an adhesive-temperature control device which controls a temperature of the adhesive present in the supply passage, by supplying a fluid having a controlled temperature to a space at least partly surrounding at least a portion of the supply passage, and (B) a pressure control device which is switchable to a pressing state thereof in which the pressure control device increases a pressure applied to the adhesive stored in the reservoir, to a value higher than an atmospheric pressure and a sucking state thereof in which the pressure control device decreases the pressure applied to the adhesive stored in the reservoir, to a value not higher than the atmospheric pressure.

* * * * *